US010442052B2

(12) United States Patent
Chang

(10) Patent No.: US 10,442,052 B2
(45) Date of Patent: Oct. 15, 2019

(54) GRINDING STROKE CONTROL DEVICE FOR A VALVE STEM GRINDING APPARATUS

(71) Applicant: YON-FONG MACHINERY CO., LTD, Changhua County (TW)

(72) Inventor: Feng-Yu Chang, Changhua County (TW)

(73) Assignee: YON-FONG MACHINERY CO., LTD, Changhua (TW)

( * ) Notice: Subject to any disclaimer, the term of this patent is extended or adjusted under 35 U.S.C. 154(b) by 191 days.

(21) Appl. No.: 15/730,741

(22) Filed: Oct. 12, 2017

(65) Prior Publication Data

US 2019/0111535 A1 Apr. 18, 2019

(51) Int. Cl.

| | |
|---|---|
| ***B24B 5/04*** | (2006.01) |
| ***B24B 47/22*** | (2006.01) |
| ***B24B 49/12*** | (2006.01) |
| ***B24B 5/36*** | (2006.01) |
| ***B24B 27/00*** | (2006.01) |
| ***B24B 27/02*** | (2006.01) |
| ***B24B 41/06*** | (2012.01) |
| ***B24B 49/03*** | (2006.01) |
| ***B24B 7/16*** | (2006.01) |

(52) U.S. Cl.

CPC ..... *B24B 5/045* (2013.01); *B24B 5/36* (2013.01); *B24B 7/16* (2013.01); *B24B 27/0076* (2013.01); *B24B 27/0084* (2013.01); *B24B 27/02* (2013.01); *B24B 41/06* (2013.01); *B24B 47/22* (2013.01); *B24B 49/03* (2013.01); *B24B 49/12* (2013.01)

(58) Field of Classification Search

CPC .. B24B 5/045; B24B 5/36; B24B 7/16; B24B 27/0076; B24B 27/0084; B24B 27/02; B24B 41/06; B24B 47/22; B24B 49/03; B24B 49/12

USPC ..... 451/276

See application file for complete search history.

(56) References Cited

U.S. PATENT DOCUMENTS

| | | | | | |
|---|---|---|---|---|---|
| 1,957,848 | A * | 5/1934 | Preston | B23B 31/202 | 279/59 |
| 2,142,565 | A * | 1/1939 | Krohn | B24B 7/16 | 125/11.19 |
| 2,182,191 | A * | 12/1939 | Albertson | B24B 7/16 | 451/276 |
| 2,182,543 | A * | 12/1939 | Murrah | B24B 7/16 | 451/242 |
| 2,502,705 | A * | 4/1950 | Choate | B24B 41/06 | 125/11.19 |
| 2,628,459 | A * | 2/1953 | Ware | B24B 5/36 | 451/283 |

(Continued)

*Primary Examiner* — George B Nguyen

(74) *Attorney, Agent, or Firm* — Bruce Stone LLP; Joseph Bruce

(57) ABSTRACT

A grinding stroke control device for a valve stem grinding apparatus is fixed to a processing machine and provided for gripping a valve stem or a test bar. Using the hand wheel, the dial gauge and the positioning seat can obtain an initial position, then moving the measuring meter of the positioning mechanism along the transverse direction to make sure the valve stem has the right length with a standard valve clearance. By such arrangements, the grinding stroke control device for a stem valve grinding apparatus of the invention can have a less complicated structure and therefore is more convenient to operate.

9 Claims, 15 Drawing Sheets

(56) References Cited

U.S. PATENT DOCUMENTS

| | | | | | |
|---|---|---|---|---|---|
| 2,645,887 | A | * | 7/1953 | Miller | B24B 7/16<br>451/276 |
| 4,457,033 | A | * | 7/1984 | Lightner | B25B 5/101<br>29/217 |
| 4,630,403 | A | * | 12/1986 | Belthle | B24B 15/04<br>451/247 |
| 4,630,977 | A | * | 12/1986 | Theofanous | B23B 31/08<br>408/127 |
| 4,987,701 | A | * | 1/1991 | Humbert | B24B 15/04<br>451/252 |
| 5,022,192 | A | * | 6/1991 | Nachbar | B24B 15/04<br>451/431 |
| 5,070,653 | A | * | 12/1991 | Amundsen | B24B 5/22<br>451/252 |

* cited by examiner

GRINDING STROKE CONTROL DEVICE FOR A VALVE STEM GRINDING APPARATUS

BACKGROUND

Field of the Invention

The present invention relates to a control device for a grinding apparatus, and more particularly to a grinding stroke control device for a valve stem grinding apparatus.

Related Prior Art

A conventional grinding stroke control device for a valve stem grinding apparatus is used to grip a valve stem M or a test bar N. The valve stem M and the test bar N each include a shaft portion M1, N1 and a fixing portion M2, N2. The fixing portion N2 of the text bar N is fixed to the shaft portion N1 by a fastener N3. As shown in FIGS. 1-3, the grinding stroke control device comprises the following components:

A base 50 is connected to an arbor 51 and a rotary seat 52 sleeved onto the arbor 51. A fixing seat 53 is disposed on the rotary seat 52, provided with an L-shaped positioning member 54, and movable with respect to the base 50 along a transverse direction R. A telescopic shaft 531 is inserted in the fixing seat 53 and movable with respect to the fixing seat 53 along the transverse direction R. One end of the telescopic shaft 531 opposite to the end inserted in the fixing seat 53 is provided with a valve-stem fixing seat 55 which is provided for fixing the valve stem M or the test bar N. The shaft portion M1, N1 penetrates the valve-stem fixing seat 55, and the fixing portion M2, N2 is abutted against the valve-stem fixing seat 55.

A position reset meter 60 is disposed on the base 50, and includes a telescopic rod 61 extending along the transverse direction R. The position reset meter 60 serves to localize the position of the fixing seat 53, and the telescopic rod 61 serves to abut against the L-shaped positioning member 54.

A length measuring meter 70 is disposed on the base 50, and includes a length measuring telescopic rod 71 extending in the transverse direction R. The length measuring meter 70 serves to measure the length of the valve stem M or the test bar N, and the length measuring telescopic rod 71 serves to abut against the valve stem M or the test bar N.

What mentioned above is the structure of the conventional grinding stroke control device of a grinding apparatus, and its operation is described as follows:

Different brands of engine valves have different lengths, and the reserved intervals between the fixed top tubes are also different from brand to brand. Therefore, before grinding the valve stem, the length of the engines valve and the reserved interval between the fixed top tubes must be measured with a test bar by following steps.

As shown in FIG. 3, firstly, inserting the test bar N in the valve guide of the cylinder head to obtain the point of contact between the fixed top tubes and the cam shaft, then tightening the fastener N3 to fix the position between the shaft portion N1 and the fixing portion N2, so that the grinding length to be ground is measured.

Then, fixing the test bar N on the valve-stem fixing seat 55 to make the fixing portion N2 assuredly abutted against the valve-stem fixing seat 55, and adjusting the position of the fixing seat 53 in the transverse direction R until the L-shaped positioning member 54 is abutted against the telescopic rod 61, and the position of 0 mm is used as a reference point to accomplish position reset.

Meanwhile, adjusting the position of the rotary seat 52 to make the front end of the test bar N come into contact with the length measuring telescopic rod 71, and using the length value measured by the length measuring meter 70 as a reference value to determine the length of the end surface of the valve disk.

After that, fixing the to-be-ground valve stem M on the valve-stem fixing seat 55, moving the rotary seat 52 while using the position reset meter 60 and the length measuring meter 70 to measure the length to be ground, and then grinding the valve stem M to a predetermined length with a grinding wheel.

However, the conventional grinding stroke control device for a valve stem grinding apparatus must be used in combination with the position reset meter 60 and the length measuring meter 70 in order to perform measuring and positioning operations, which makes the grinding control device difficult to operate, and the structure is also relatively complicated.

The present invention has arisen to mitigate and/or obviate the afore-described disadvantages.

SUMMARY

One objective of the present invention is to provide a grinding stroke control device for a valve stem grinding apparatus which is easy to operate.

Another objective of the present invention is to simplify the relative structure.

To achieve the above objectives, a grinding stroke control device for a valve stem grinding apparatus in accordance with the present invention is fixed to a processing machine, the processing machine comprises a grinding wheel, wherein the grinding stroke control device is provided for gripping a valve stem or a test bar, the valve stem and the test bar each include a shaft portion and a fixing portion connected to the shaft portion, the grinding stroke control device comprises:

an arbor extending from the processing machine along a transverse direction;

a positioning mechanism including a fixing seat, an adjustment member, a movable seat and a measuring meter, wherein the fixing seat is fixed to the processing machine, the adjustment member is mounted on and movable with respect to the fixing seat along the transverse direction, the movable seat is fixed to the adjustment member and therefore movable in the transverse direction along with the adjustment member, the measuring meter is fixed to the movable seat and includes a telescopic rod extending in the transverse direction and provided for contacting the shaft portion;

a rotary mechanism including a rotary seat, a press rod and a positioning seat, wherein the rotary seat is coupled to and movable with respect to the arbor along the transverse direction, the rotary seat is rotatable with respect to the arbor and includes a sleeve portion and a gripping portion which extend in different directions, the sleeve portion is sleeved onto the arbor, and includes a rotary section and an adjustment section connected to the rotary section, the rotary section is connected to the gripping portion and rotatable with respect to the arbor, so as to allow the gripping portion to rotate about the arbor, the adjustment section includes a hand wheel and a dial gauge, rotating the hand wheel can move the rotary seat along the transverse direction, the dial gauge rotates synchronously with the hand wheel to measure a rotation angle of the hand wheel, and then infer a amount of displacement of the rotary seat, the gripping portion includes a gripping groove, the press rod is capable of being movably inserted into or moved out of the gripping groove, and is provided for pressing against the shaft portion of the valve stem or the test bar, so that the shaft portion is fixed in the gripping groove without moving in the transverse direction, the positioning seat is coupled to the gripping portion, movable with respect to the gripping portion along the transverse direction, and includes two abutting portions to be abutted against by the fixing portion, and a passage for insertion of the shaft portion is defined between the two abutting portions.

It can be learned from the above description that, using the hand wheel, the dial gauge and the positioning seat can obtain an initial position, then moving the measuring meter of the positioning mechanism along the transverse direction to make sure the valve stem has the right length with a standard valve clearance. By such arrangements, the grinding stroke control device for a stem valve grinding apparatus of the invention can have a less complicated structure and therefore is more convenient to operate.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

DETAILED DESCRIPTION

Figure 1:
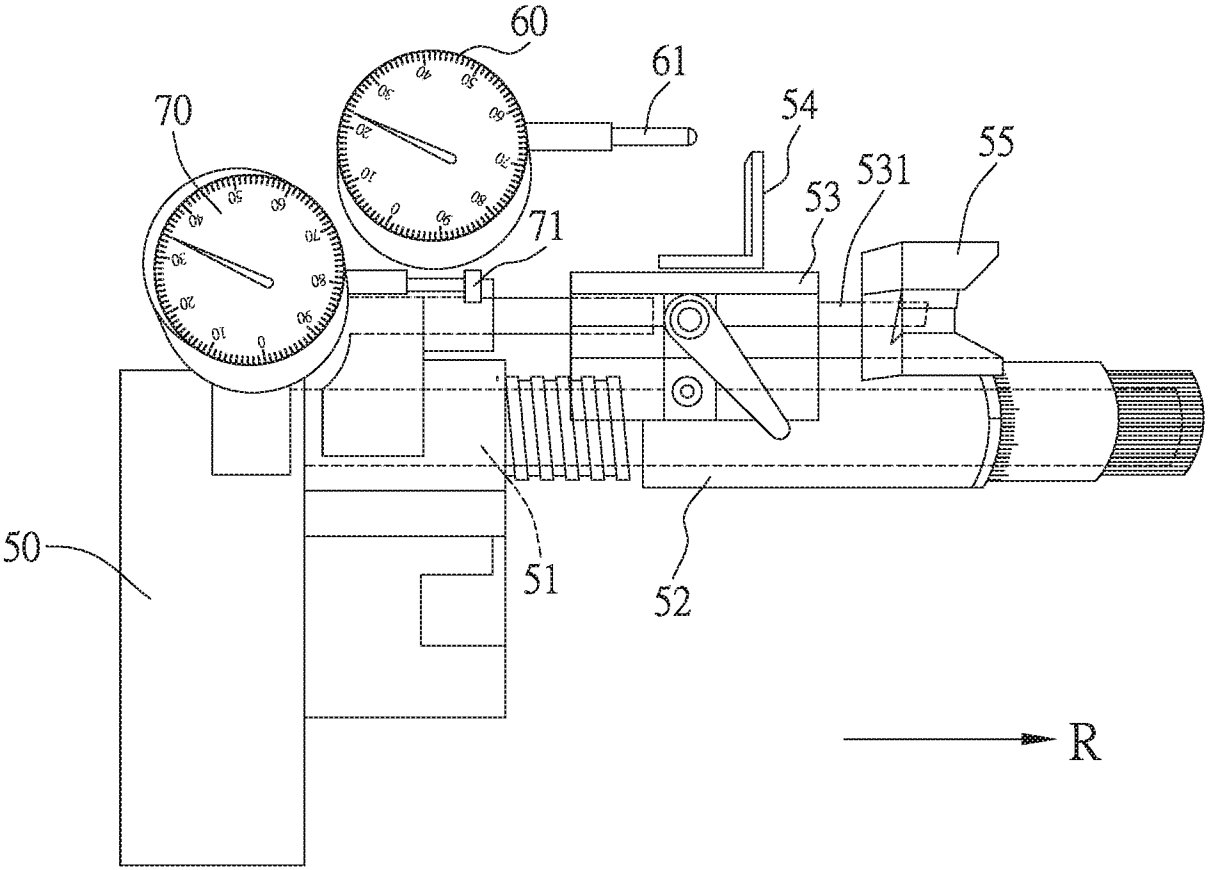
PRIOR ART FIG.1
FIG. 1 shows a conventional grinding stroke control device for a valve stem grinding apparatus.
Figure 2:
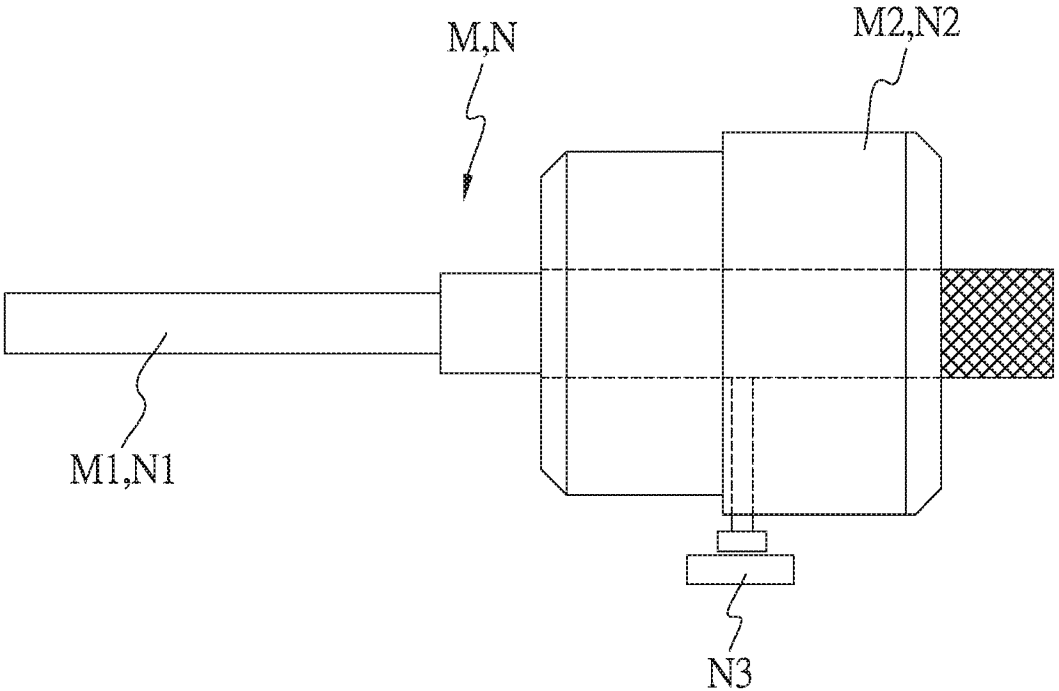
PRIOR ART FIG.2
FIG. 2 shows a test bar.
Figure 3:
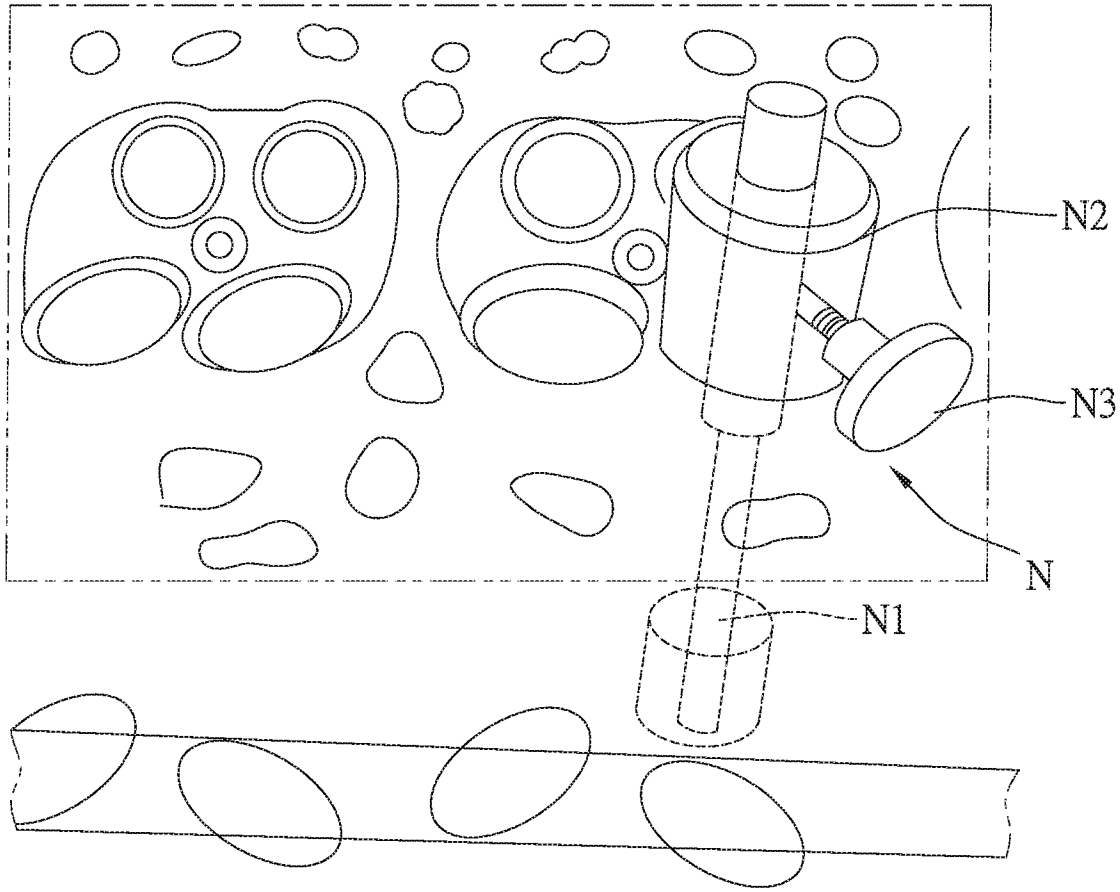
PRIOR ART FIG.3
FIG. 3 shows that the test bar is inserted in the valve guide of the cylinder head.
Figure 4:
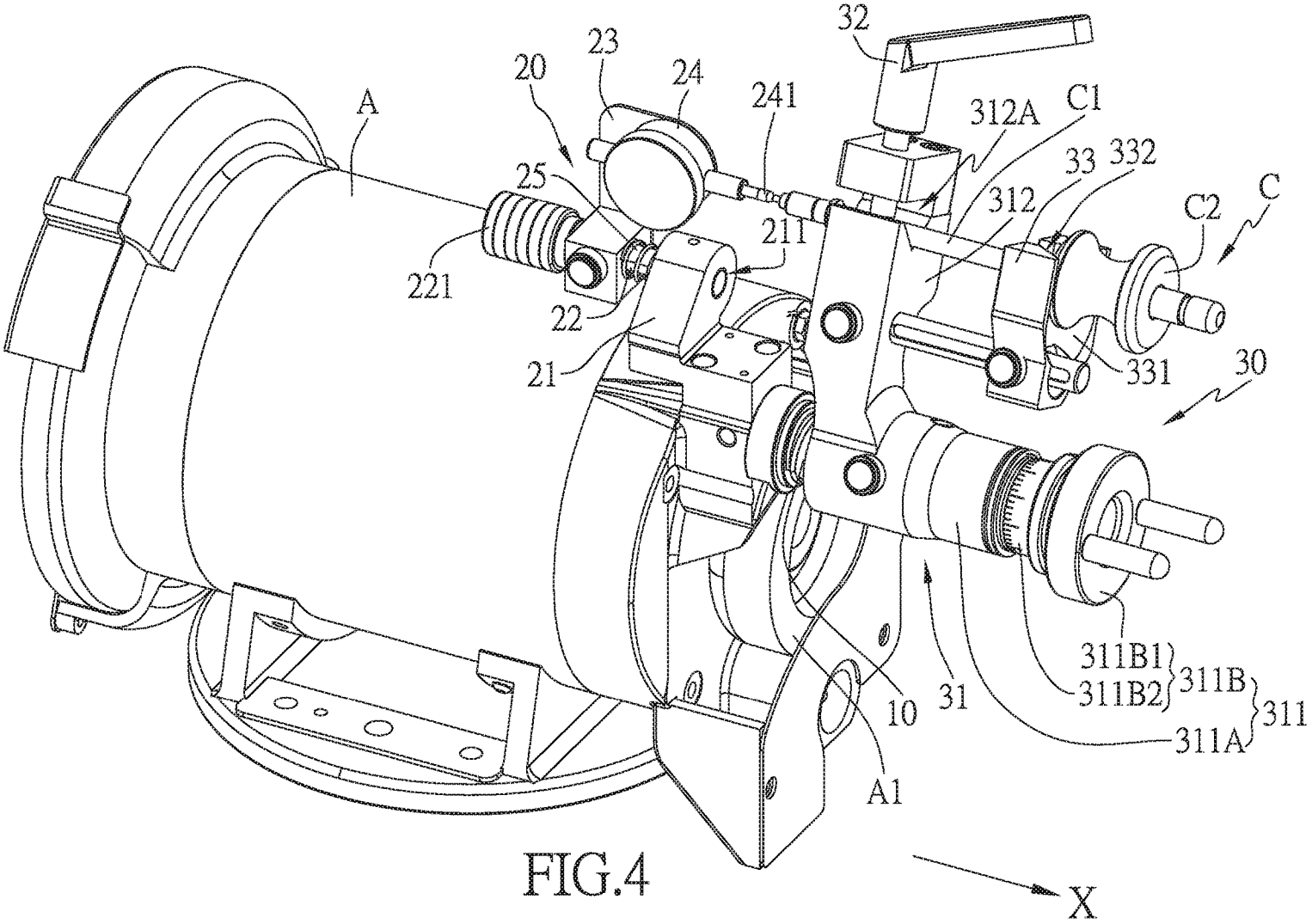
FIG. 4 is a perspective view of a grinding stroke control device for a valve stem grinding apparatus in accordance with a preferred embodiment of the present invention.
Figure 5:
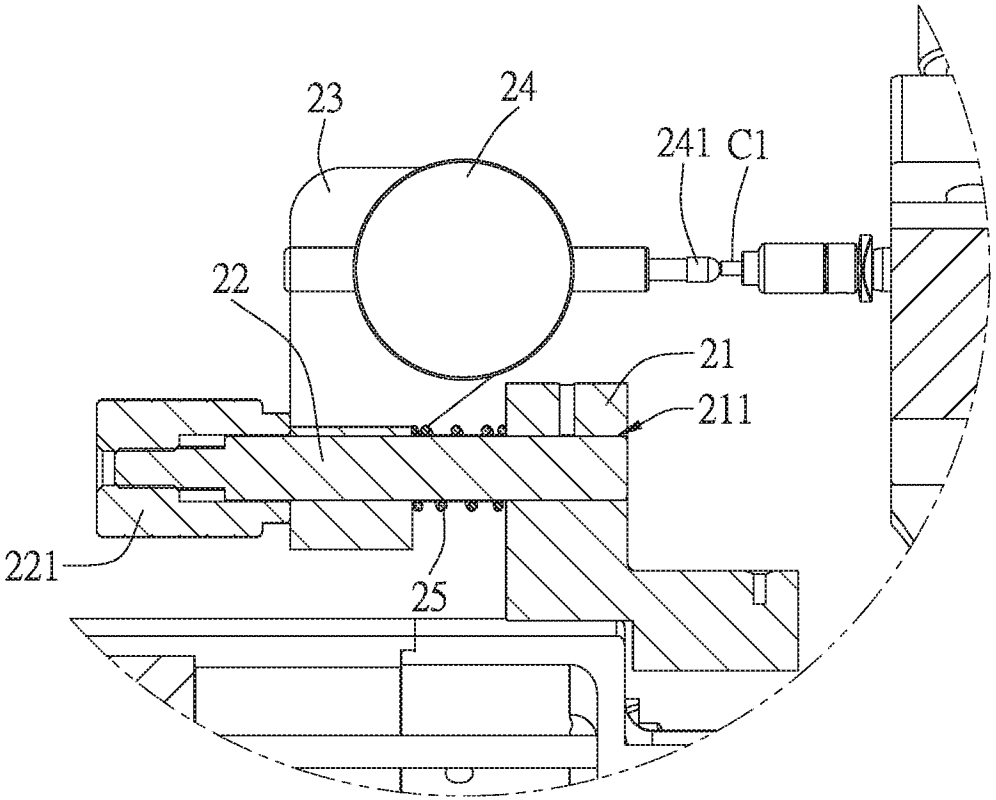
FIG. 5 is a cross sectional view of a part of the grinding stroke control device for a valve stem grinding apparatus in accordance with the preferred embodiment of the present invention.

The present invention will be clearer from the following description when viewed together with the accompanying drawings, which show, for purpose of illustrations only, the preferred embodiment in accordance with the present invention.

The grinding stroke control device for a valve stem grinding apparatus in accordance with the preferred embodiment of the present invention is fixed to a processing machine A which comprises a grinding wheel A1. The grinding stroke control device of the invention is provided for gripping a valve stem B or a test bar C. The valve stem B and the test bar C each include a shaft portion B1, C1 and a fixing portion B2, C2 connected to the shaft portion B1, C1. The fixing portion C2 of the test bar C is fixed to the shaft portion C1 by a fastener. As shown in FIGS. 4-11, the grinding stroke control device of the invention comprises an arbor 10, a positioning mechanism 20, and a rotary mechanism 30.

The arbor 10 extends from the processing machine A along a transverse direction X.

The positioning mechanism 20 includes a fixing seat 21, an adjustment member 22, a movable seat 23 and a measuring meter 24. The fixing seat 21 is fixed to the processing machine A and includes a pivot hole 211.

The adjustment member 22 is mounted on and movable with respect to the fixing seat 21 along the transverse direction X. In this embodiment, the adjustment member 22 has one end inserted in the pivot hole 211, and another end provided with an adjustment portion 221 for gripping by a user.

The movable seat 23 is fixed to the adjustment member 22 and therefore movable in the transverse direction X along with the adjustment member 22.

The measuring meter 24 is fixed to the movable seat 23 and therefore movable in the transverse direction X along with the adjustment member 22. The measuring meter 24 includes a telescopic rod 241 extending in the transverse direction X and provided for contacting or pressing the shaft portion B1, C1.

Preferably, the positioning mechanism 20 further includes an elastic member 25 sleeved onto the adjustment member 22 and located between the movable seat 23 and the fixing seat 21 to provide a force for pushing the movable seat 23 away from the fixing seat 21.

The rotary mechanism 30 includes: a rotary seat 31, a press rod 32 and a positioning seat 33. The rotary seat 31 is coupled to and movable with respect to the arbor 10 along the transverse direction X. The rotary seat 31 is rotatable with respect to the arbor 10 and includes: a sleeve portion 311 and a gripping portion 312 which extend in different directions. The sleeve portion 311 extends in the transverse direction X, and the gripping portion 312 extends in a direction perpendicular to the extending direction of the sleeve portion 311.

The sleeve portion 311 is sleeved onto the arbor 10, and includes: a rotary section 311A and an adjustment section 311B connected to the rotary section 311A. The rotary section 311A is connected to the gripping portion 312, and rotatable with respect to the arbor 10, which allows the gripping portion 312 to rotate about the arbor 10. The adjustment section 311B includes a hand wheel 311B1 and a dial gauge 311B2. Rotating the hand wheel 311B1 can move the rotary seat 31 along the transverse direction X. The rotation angle of the hand wheel 311B1 is proportional to the amount of displacement of the rotary seat 31 along the transverse direction X. The dial gauge 311B2 rotates synchronously with the hand wheel 311B1 to measure the rotation angle of the hand wheel 311B1, which consequently can infer the amount of displacement of the rotary seat 31. The gripping portion 312 includes a gripping groove 312A extending in the transverse direction X.

The press rod 32 can be movably inserted into or moved out of the gripping groove 312A, and is provided for pressing against the shaft portion B1, C1 of the valve stem B or the test bar C, so that the shaft portion B1, C1 is fixed in the gripping groove 312A without moving in the transverse direction X. In this embodiment, the press rod 32 is coupled to the gripping portion 312 and movable along a height direction Y which is perpendicular to the transverse direction X.

The positioning seat 33 is coupled to the gripping portion 312, movable with respect to the gripping portion 312 along the transverse direction X, and includes two abutting portions 331 to be abutted against by the fixing portion B2, C2, and between the two abutting portions 331 is a passage 332 for insertion of the shaft portion B1, C1.

In another preferred embodiment of the invention, as shown in FIGS. 12-15 the grinding stroke control device for a valve stem grinding apparatus further comprises an optical measuring device 80 which includes a positioning seat 81, a mounting member 82, a sensor 83, and a to-be-sensed member 84. The positioning seat 81 is fixed to the fixing seat 21 and located at another side of the fixing seat 21 opposite to the side where the movable seat 23 is located. The positioning seat 81 includes an extension portion 811 extending along the transverse direction X. The mounting member 82 is fixed to the extension portion 811 of the positioning seat 81 by a bolt D, and includes a connecting portion 821 and a mounting portion 822 connected to the connecting portion 821. The connecting portion 821 is bent at an angle with respect to the mounting portion 822, so that the mounting member 82 has an L shape. The connecting portion 821 is fixed to the extension portion 811 of the positioning seat 81 by the bolt D, and the sensor 83 is fixed to the mounting portion 822 of the mounting member 82.

The rotary seat 31 is provided with a slide groove 313 extending along the transverse direction X. The slide groove 313 is formed on the gripping portion 312 and located opposite to the gripping groove 312A. The to-be-sensed member 84 is fixed in the slide groove 313 and slides in the transverse direction X along with the rotary seat 31. The sensor 83 is capable of measuring the displacement of the to-be-sensed member 84, and is signally connected to a display 832 by a wire 833, so that the data detected by the sensor 83 is displayed on the display 832.

Figure 6:
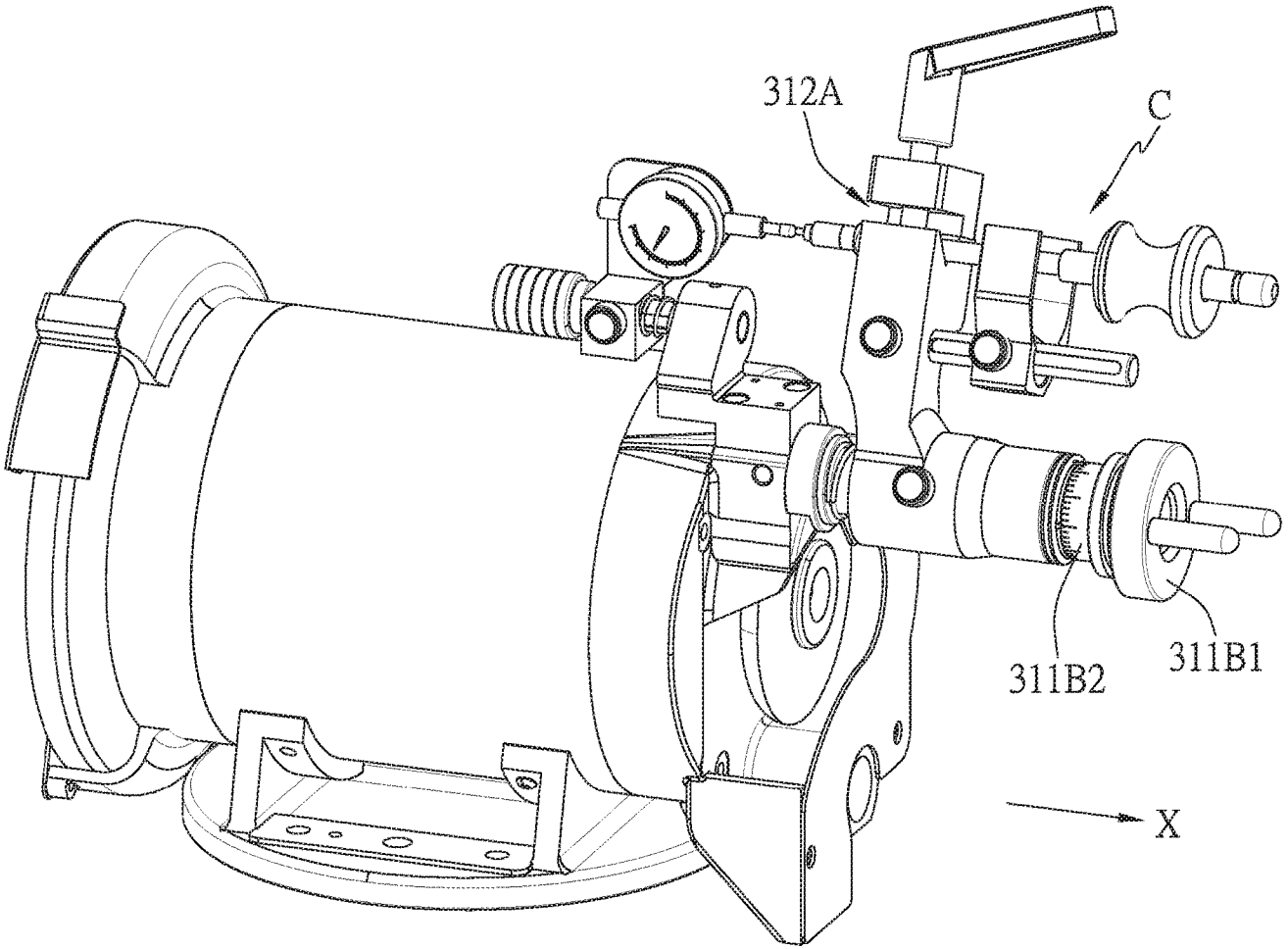
FIG. 6 is an operational view of the grinding stroke control device for a valve stem grinding apparatus in accordance with the preferred embodiment of the present invention.
Figure 7:
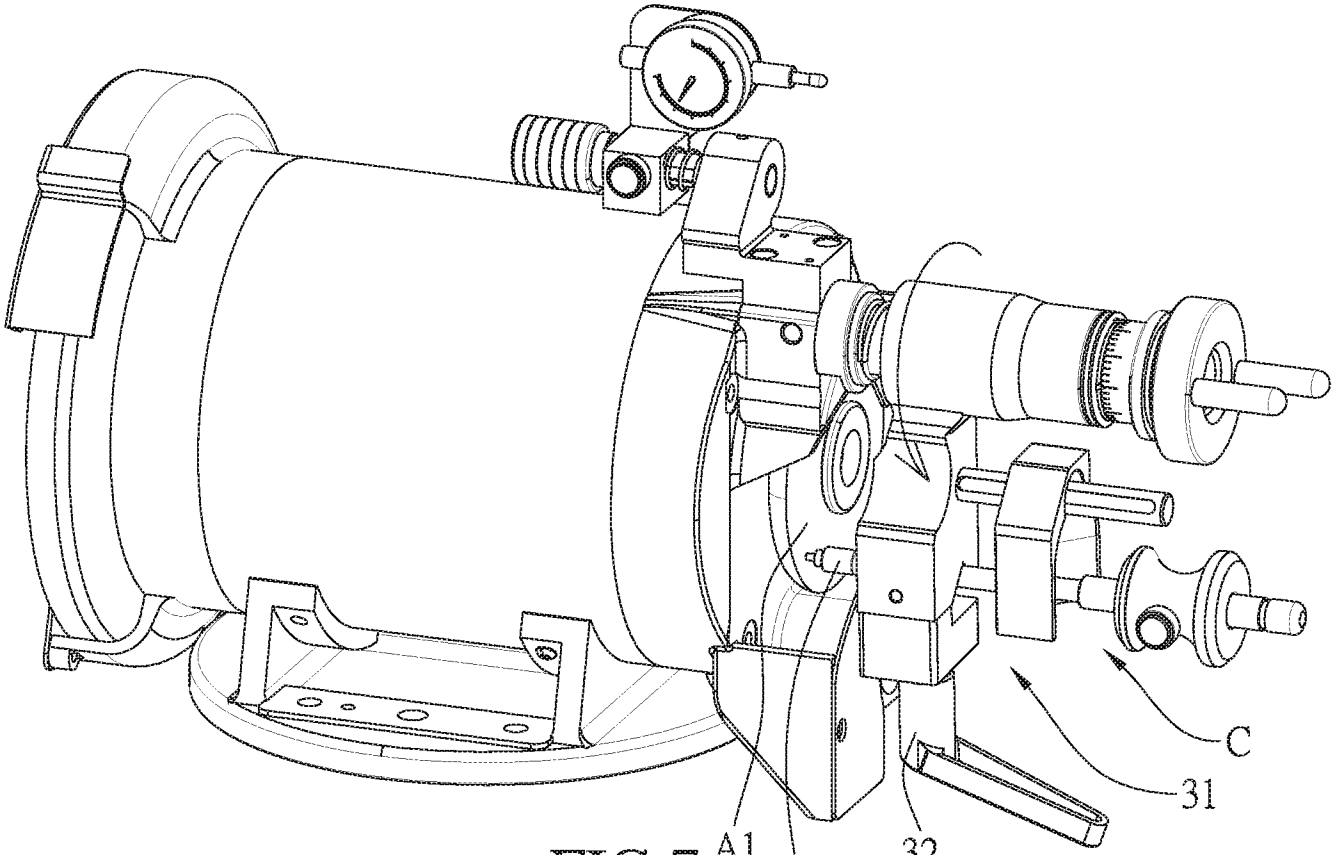
FIG. 7 is an operational view of the grinding stroke control device for a valve stem grinding apparatus in accordance with the preferred embodiment of the present invention.
Figure 8:
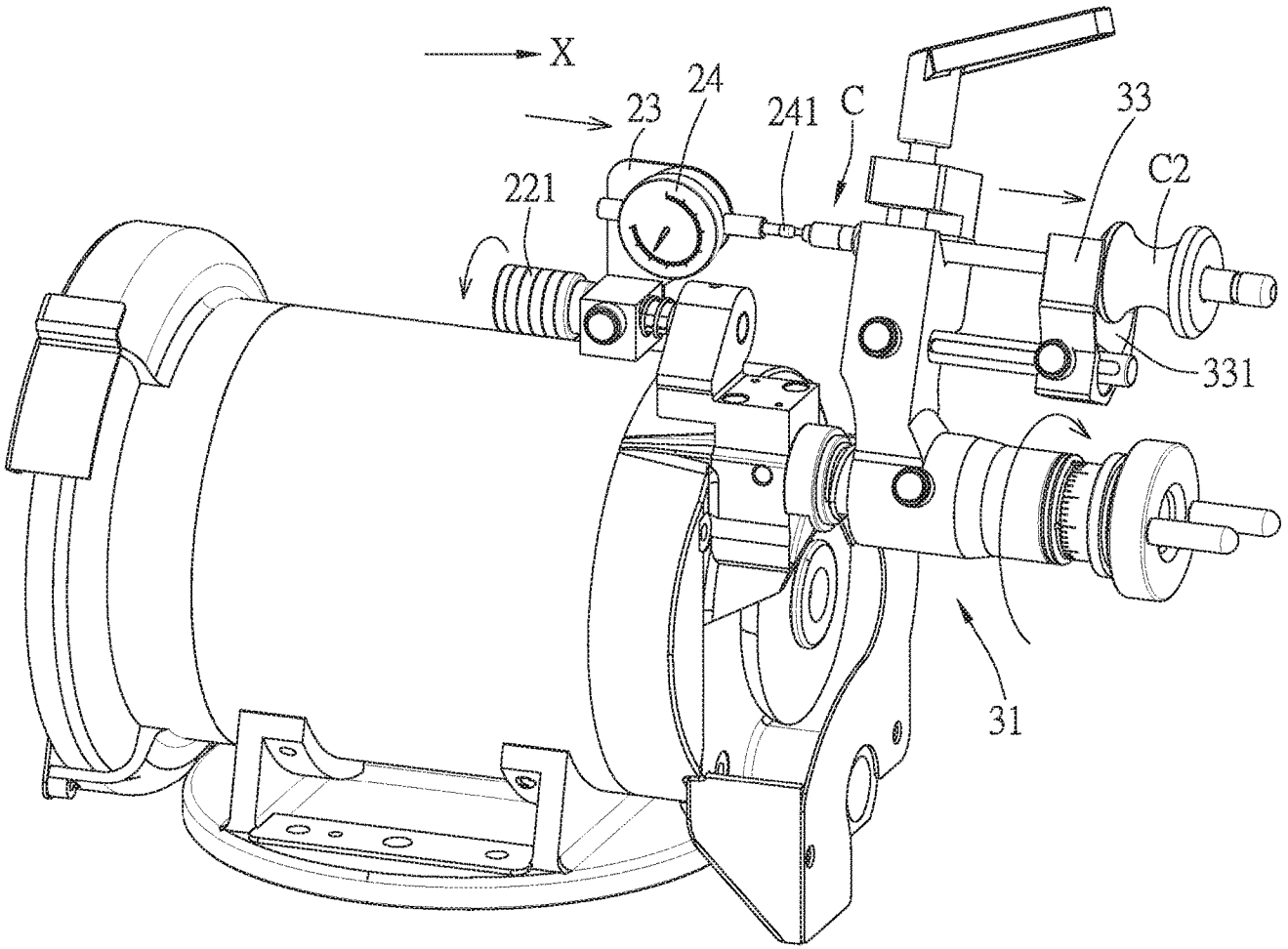
FIG. 8 is an operational view of the grinding stroke control device for a valve stem grinding apparatus in accordance with the preferred embodiment of the present invention.
Figure 9:
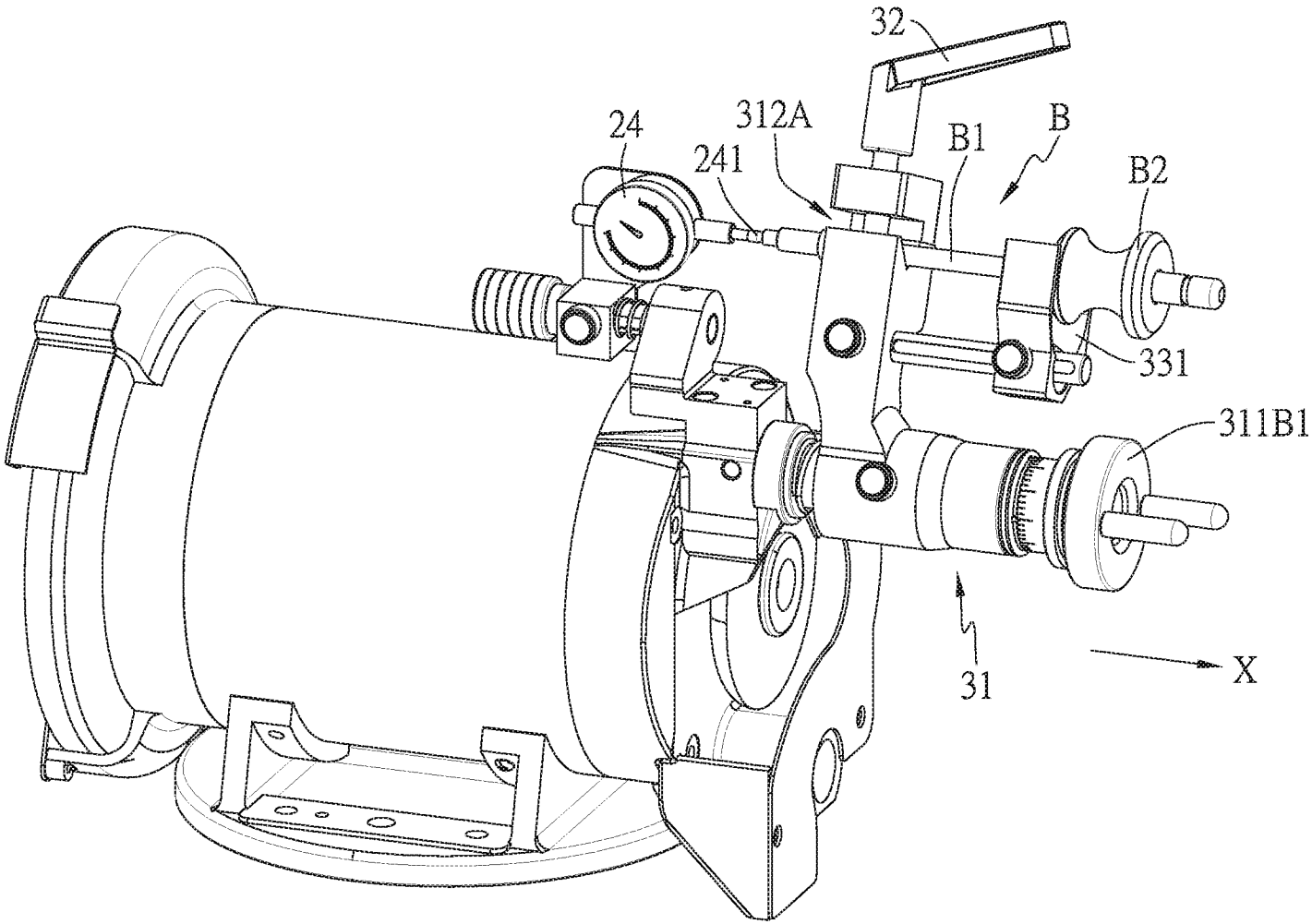
FIG. 9 is an operational view of the grinding stroke control device for a valve stem grinding apparatus in accordance with the preferred embodiment of the present invention.
Figure 10:
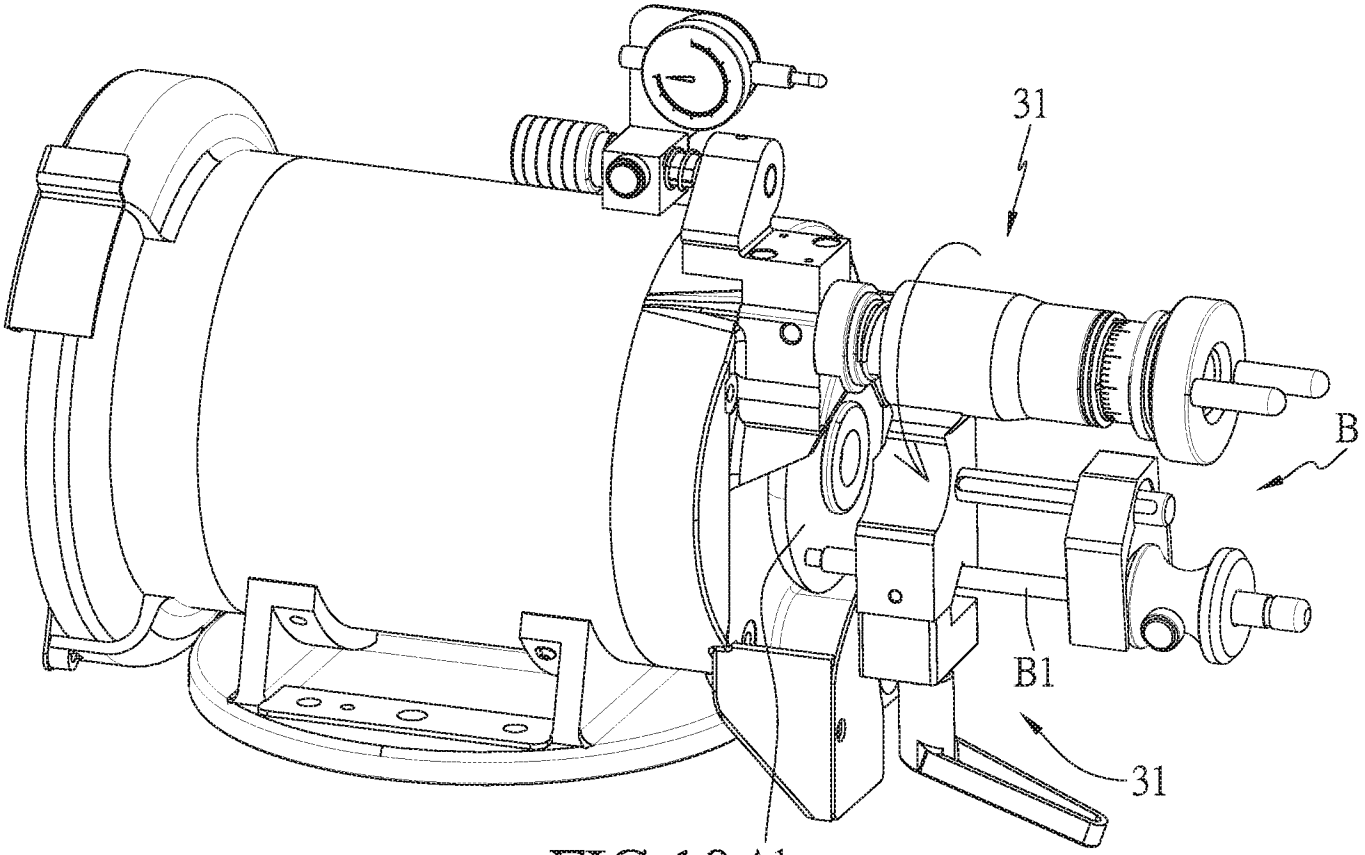
FIG. 10 is an operational view of the grinding stroke control device for a valve stem grinding apparatus in accordance with the preferred embodiment of the present invention.
Figure 11:
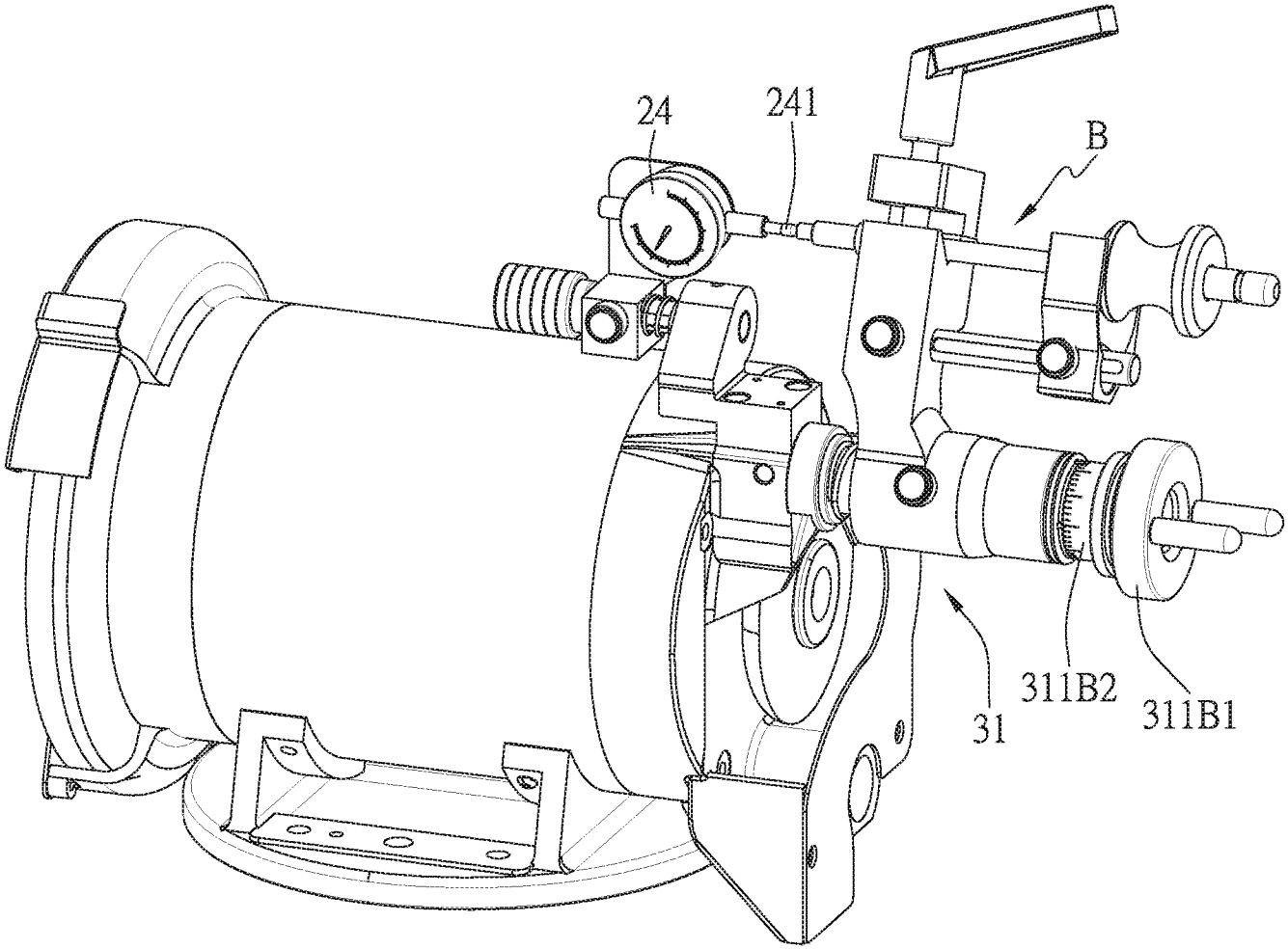
FIG. 11 is an operational view of the grinding stroke control device for a valve stem grinding apparatus in accordance with the preferred embodiment of the present invention.
Figure 12:
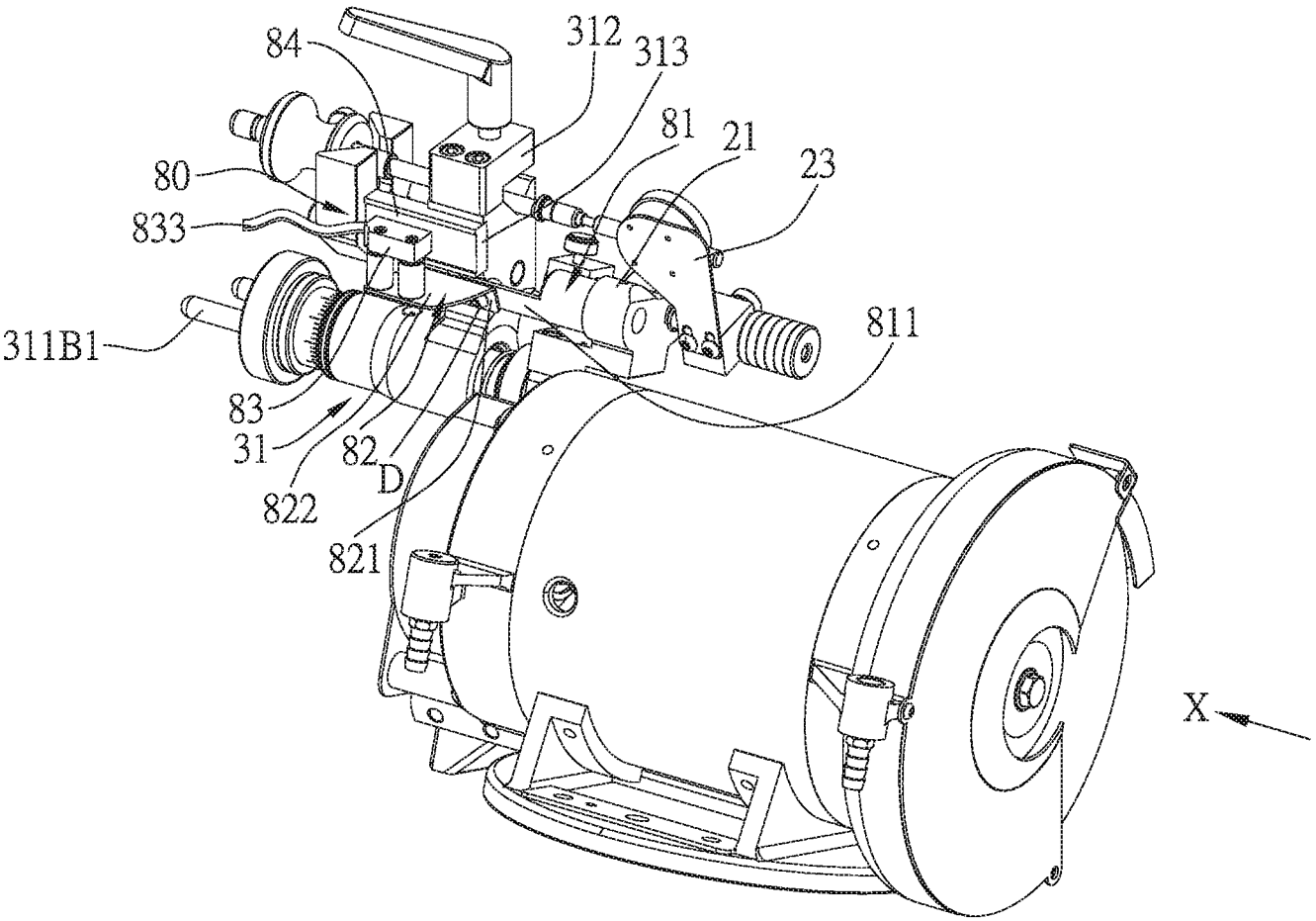
FIG. 12 is a perspective view of a grinding stroke control device for a valve stem grinding apparatus in accordance with another preferred embodiment of the present invention.
Figure 13:
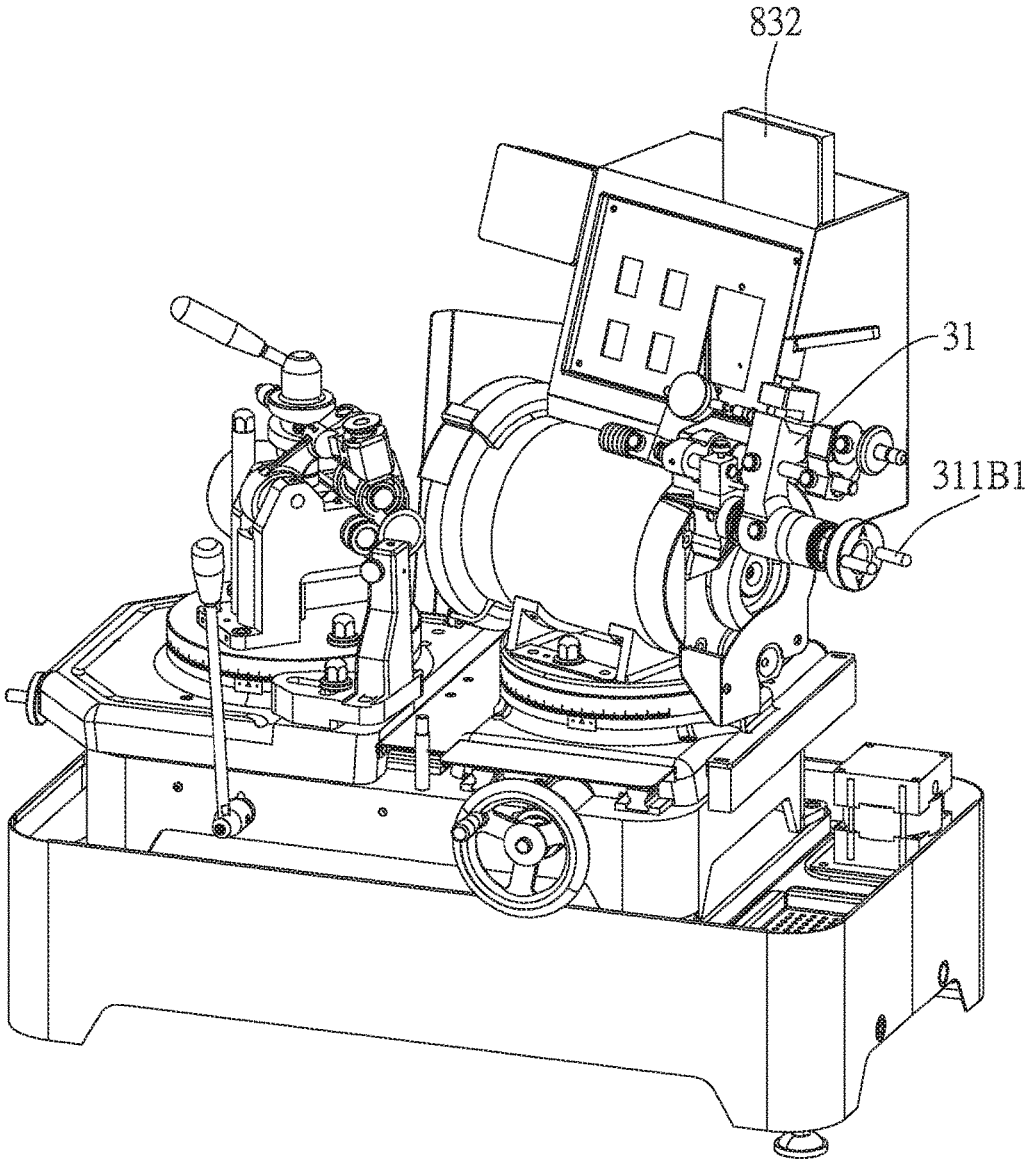
FIG. 13 is an operational view of a grinding stroke control device for a valve stem grinding apparatus in accordance with another preferred embodiment of the present invention.
Figure 14:
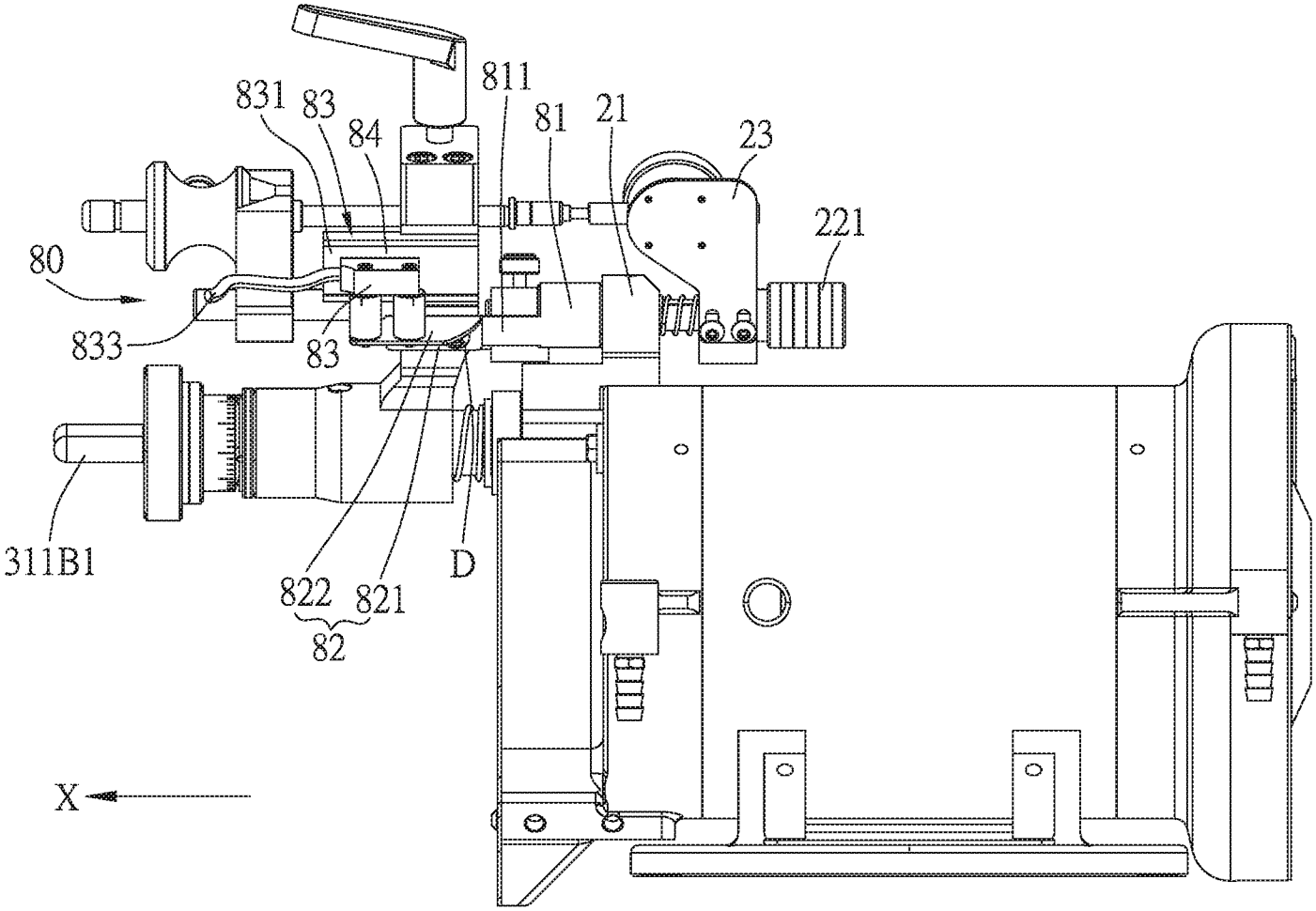
FIG. 14 is another operational view of a grinding stroke control device for a valve stem grinding apparatus in accordance with another preferred embodiment of the present invention.
Figure 15:
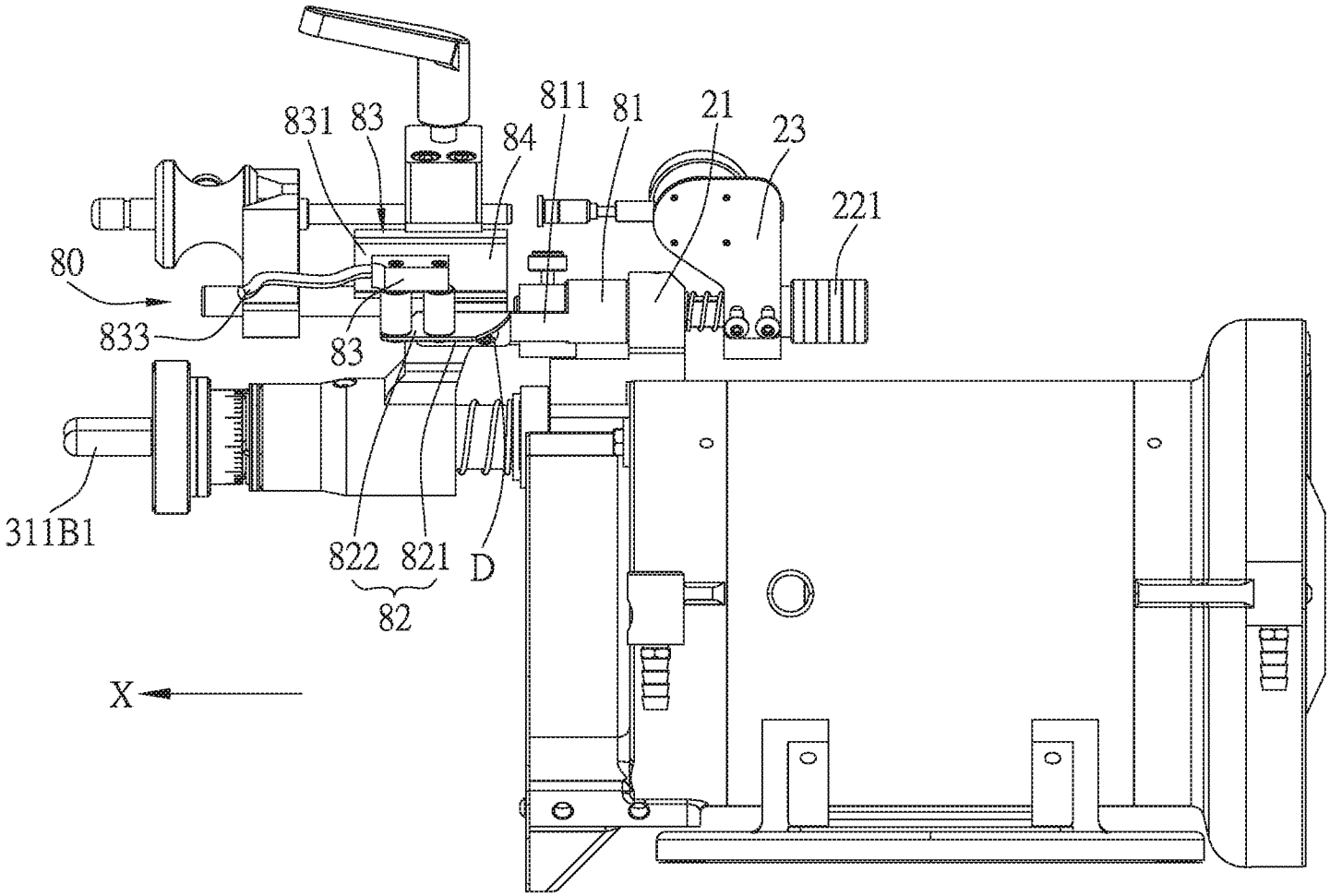
FIG. 15 is another operational view of a grinding stroke control device for a valve stem grinding apparatus in accordance with another preferred embodiment of the present invention.

What mentioned above is the structure of the grinding stroke control device of a valve stem grinding apparatus in accordance with the present invention, and its operation involves the following steps:

After the length to be ground is measured by the test bar C;

Firstly, as shown in FIG. 6, adjusting the hand wheel 311B1 to a position corresponding to 0 degree on the dial gauge with the use of the dial gauge 311B2, inserting the test bar C along the transverse direction X into the gripping groove 312A;

Then, as shown in FIG. 7, rotating the rotary seat 31 to make the shaft portion C1 of the test bar C come into contact with the grinding wheel A1, and make the press rod 32 press against the shaft portion C1 to fix the test bar C;

As shown in FIG. 8, rotating the rotary seat 31 again to return the test bar C to a position where the test bar C can come into contact with the telescopic rod 241, then rotating the adjustment portion 221 to move the movable seat 23 along the transverse direction X until the telescopic rod 241 comes into contact with the test C, then returning the reading of the measuring meter 24 to zero;

Moving the positioning seat 33 to make the abutting portions 331 abut against the fixing portion C2, then fixing the positioning seat 33 to define an initial position;

As shown in FIG. 9, releasing the press rod 32 to take out the test bar C, then moving the valve stem B along the transverse direction X into the gripping groove 312A, and making sure that the fixing portion B2 of the valve stem B is abutted against the abutting portions 331 to reach the initial position, at this moment, the shaft portion B1 of the valve stem B is abutted against the telescopic rod 241;

Observing the measuring meter 24 to see how much the reading exceeds the zero point, then rotating the hand wheel 311B1 to move the rotary seat 31 (backward) along the transverse direction X;

As shown in FIGS. 10 and 11, rotating the rotary seat 31 again until the shaft portion B1 comes into contact with and is ground by the grinding wheel A1, after grinding process, rotating the rotary seat 31 again to return the valve stem B to the position where the valve stem B is able to come into contact with the telescopic rod 241, then adjusting the hand wheel 311B1 until the dial gauge 311B2 returns to zero, meanwhile, the measuring meter 24 displays a predetermined value (−0.16 mm for example), namely, allowing the valve stem B to have the right length with a standard valve clearance.

In another embodiment of the invention, rotating the hand wheel 311B1 to the position corresponding to the zero point of the sensor 83 can return the reading to zero, then inserting the test bar C along the transverse direction X into the gripping groove 312A, then the rotary mechanism 30 moves in the transverse direction X after rotation of the hand wheel 311B1, and the to-be-sensed member 84 also moves in the transverse direction X together with the rotary mechanism 30, so that the sensor 83 will detect the displacement of the to-be-sensed member 84, and the detected data will be transmitted to and displayed on the display 832 via the wire 833.

Besides, after the grinding wheel A1 performed the grinding operation and the rotary seat 31 is rotated to move the valve stem B back to the position where the valve stem B is abutted against the telescopic rod 241, then adjust the hand wheel 311B1 and detect the displacement of the to-be-sensed member 84 with the sensor 83, and return the reading displayed on the display 832 to zero. When the reading of the measuring meter 24 reaches the predetermined value, it means that the valve stem B has the right length with a standard valve clearance.

It can be learned from the above description that, using the hand wheel 311B1, the dial gauge 311B2 and the positioning seat 33 can obtain an initial position, then moving the measuring meter 24 of the positioning mechanism 20 along the transverse direction X to make sure the valve stem B has the right length with a standard valve clearance. By such arrangements, the grinding stroke control device for a stem valve grinding apparatus of the invention can have a less complicated structure and therefore is more convenient to operate.

While we have shown and described various embodiments in accordance with the present invention, it is clear to those skilled in the art that further embodiments may be made without departing from the scope of the present invention.

What is claimed is:

1. A grinding stroke control device for a valve stem grinding apparatus being fixed to a processing machine, the processing machine comprising a grinding wheel, wherein the grinding stroke control device is provided for gripping a valve stem or a test bar, the valve stem and the test bar each include a shaft portion and a fixing portion connected to the shaft portion, the grinding stroke control device comprising:

an arbor extending from the processing machine along a transverse direction;

a positioning mechanism including a fixing seat and a measuring meter, wherein the fixing seat is fixed to the processing machine, the measuring meter is mounted on and movable with respect to the fixing seat along the transverse direction, the measuring meter includes a telescopic rod provided for contacting the shaft portion;

a rotary mechanism including: a rotary seat, a press rod and a positioning seat, wherein the rotary seat is coupled to and movable with respect to the arbor along the transverse direction, the rotary seat is rotatable with respect to the arbor and includes a hand wheel and a dial gauge, rotating the hand wheel causes movement of the rotary seat along the transverse direction, the dial gauge rotates synchronously with the hand wheel, the rotary seat includes a gripping groove, the press rod is capable of being movably inserted into or moved out of the gripping groove, and is provided for pressing against the shaft portion of the valve stem or the test bar, the positioning seat is coupled to and movable with respect to the rotary seat along the transverse direction, and the positioning seat is to be abutted against by the fixing portion, and includes a passage for insertion of the shaft portion.

2. The grinding stroke control device as claimed in claim 1, wherein the rotary seat includes a sleeve portion and a gripping portion which extend in different directions, and the hand wheel and the dial gauge are located on the sleeve portion.

3. A grinding stroke control device for a valve stem grinding apparatus being fixed to a processing machine, the processing machine comprising a grinding wheel, wherein the grinding stroke control device is provided for gripping a valve stem or a test bar, the valve stem and the test bar each include a shaft portion and a fixing portion connected to the shaft portion, the grinding stroke control device comprising:

an arbor extending from the processing machine along a transverse direction;

a positioning mechanism including a fixing seat, an adjustment member, a movable seat and a measuring meter, wherein the fixing seat is fixed to the processing machine, the adjustment member is mounted on and movable with respect to the fixing seat along the transverse direction, the movable seat is fixed to the adjustment member and therefore movable in the transverse direction along with the adjustment member, the measuring meter is fixed to the movable seat and includes a telescopic rod extending in the transverse direction and provided for contacting the shaft portion;

a rotary mechanism including a rotary seat, a press rod and a positioning seat, wherein the rotary seat is coupled to and movable with respect to the arbor along the transverse direction, the rotary seat is rotatable with respect to the arbor and includes a sleeve portion and a gripping portion which extend in different directions, the sleeve portion is sleeved onto the arbor, and includes a rotary section and an adjustment section connected to the rotary section, the rotary section is connected to the gripping portion and rotatable with respect to the arbor, so as to allow the gripping portion to rotate about the arbor, the adjustment section includes a hand wheel and a dial gauge, rotating the hand wheel can move the rotary seat along the transverse direction, the dial gauge rotates synchronously with the hand wheel to measure a rotation angle of the hand wheel, and then infer a amount of displacement of the rotary seat, the gripping portion includes a gripping groove;

the press rod is capable of being movably inserted into or moved out of the gripping groove, and is provided for pressing against the shaft portion of the valve stem or the test bar, so that the shaft portion is fixed in the gripping groove without moving in the transverse direction, the positioning seat is coupled to the gripping portion, movable with respect to the gripping portion along the transverse direction, and includes two abutting portions to be abutted against by the fixing portion, and a passage for insertion of the shaft portion is defined between the two abutting portions.

4. The grinding stroke control device as claimed in claim 3, wherein the fixing seat includes a pivot hole, the adjustment member has one end inserted in the pivot hole, and another end provided with an adjustment portion for gripping by a user.

5. The grinding stroke control device as claimed in claim 3 further comprising an elastic member sleeved onto the adjustment member and located between the movable seat and the fixing seat to provide a force for pushing the movable seat away from the fixing seat.

6. A grinding stroke control device for a valve stem grinding apparatus being fixed to a processing machine, the processing machine comprising a grinding wheel, wherein the grinding stroke control device is provided for gripping a valve stem or a test bar, the valve stem and the test bar each include a shaft portion and a fixing portion connected to the shaft portion, the grinding stroke control device comprising:

an arbor extending from the processing machine along a transverse direction;

a positioning mechanism including a fixing seat and a measuring meter, wherein the fixing seat is fixed to the processing machine, the measuring meter is mounted on and movable with respect to the fixing seat along the transverse direction, the measuring meter includes a telescopic rod provided for contacting the shaft portion;

a rotary mechanism including: a rotary seat, a press rod and a positioning seat, wherein the rotary seat is coupled to and movable with respect to the arbor along the transverse direction, the rotary seat is provided with a slide groove extending along the transverse direction, the rotary seat is rotatable with respect to the arbor and includes a hand wheel, rotating the hand wheel causes movement of the rotary seat along the transverse direction, the rotary seat includes a gripping groove;

an optical measuring device includes a positioning seat, a mounting member, a sensor, and a to-be-sensed member, the positioning seat is fixed to the fixing seat, the mounting member is fixed to the positioning seat and includes a connecting portion and a mounting portion connected to the connecting portion, the connecting portion is fixed to the positioning seat, and the sensor is fixed to the mounting portion of the mounting member, the to-be-sensed member is fixed in the slide groove and capable of detecting a displacement of the to-be-sensed member;

the press rod is capable of being movably inserted into or moved out of the gripping groove, and is provided for pressing against the shaft portion of the valve stem or the test bar;

the positioning seat is coupled to and movable with respect to the rotary seat along the transverse direction, and the positioning seat is to be abutted against by the fixing portion, and includes a passage for insertion of the shaft portion.

7. The grinding stroke control device as claimed in claim 6, wherein the sensor is signally connected to a display by a wire, so that data detected by the sensor is displayed on the display.

8. The grinding stroke control device as claimed in claim 6, wherein the fixing seat includes a pivot hole, the adjustment member has one end inserted in the pivot hole, and another end provided with an adjustment portion for gripping by a user.

9. The grinding stroke control device as claimed in claim 6 further comprising an elastic member sleeved onto the adjustment member and located between the movable seat and the fixing seat to provide a force for pushing the movable seat away from the fixing seat.

* * * * *